United States Patent [19]

Mingaud et al.

[11] Patent Number: 4,746,495

[45] **Date of Patent: * May 24, 1988**

[54] INSTALLATION FOR CHEMICAL CONVERSION OF A GAS MIXTURE CONTAINING HYDROGEN AND HYDROCARBONS

[75] Inventors: Jean-Louis Mingaud, Paris; Christian Plard, Le Pecq; Pierre Cros; Jacques Vanrenterghem, both of Paris, all of France

[73] Assignees: Electricite de France, Paris; SPIE-Batignolles, Puteaux, both of France

[ * ] Notice: The portion of the term of this patent subsequent to Mar. 18, 2003 has been disclaimed.

[21] Appl. No.: 838,438

[22] Filed: Mar. 10, 1986

Related U.S. Application Data

[63] Continuation of Ser. No. 581,046, Feb. 17, 1984, abandoned.

[30] Foreign Application Priority Data

Feb. 21, 1983 [FR] France ..... 83 02764

[51] Int. Cl.[4] ..... C10G 35/04; B01J 8/04

[52] U.S. Cl. ..... 422/190; 422/115; 422/198; 208/134

[58] Field of Search ..... 422/189, 190, 199, 115, 422/198; 208/134, DIG. 1

[56] References Cited

U.S. PATENT DOCUMENTS

| | | | |
|---|---|---|---|
| 1,868,096 | 7/1932 | Dreyfus | 422/189 |
| 1,915,567 | 6/1933 | Carter | 219/298 |
| 2,210,257 | 8/1940 | Pÿzel et al. | 422/190 |
| 2,947,682 | 8/1960 | Friedman | 208/134 |
| 3,128,242 | 4/1964 | Bergstrom et al. | 422/190 |
| 3,626,153 | 12/1971 | Horton | 219/374 |
| 4,166,024 | 8/1979 | Swan . | |
| 4,341,167 | 7/1982 | St. John | 110/210 |
| 4,417,131 | 11/1983 | Carl | 219/279 |
| 4,577,093 | 3/1986 | Plard et al. | 219/376 |

*Primary Examiner*—David L. Lacey
*Attorney, Agent, or Firm*—Young & Thompson

[57] ABSTRACT

An installation for chemical conversion of a gas mixture containing hydrogen and hydrocarbons comprises a series of reactors in which the gas mixture undergoes endothermic reactions at temperatures within the range of 350° C. to 900° C. A furnace is placed upstream of each reactor for reheating the gas mixture prior to introduction into the reactor. The furnaces are equipped with electric heating resistors which are intended to be placed in direct contact with the gas mixture as it is introduced into each furnace.

4 Claims, 7 Drawing Sheets

INSTALLATION FOR CHEMICAL CONVERSION OF A GAS MIXTURE CONTAINING HYDROGEN AND HYDROCARBONS

This application is a continuation of application Ser. No. 581,046 filed Feb. 17, 1984, and now abandoned.

This invention relates to an installation for the chemical conversion of a gas mixture containing in particular hydrocarbons and hydrogen.

This installation comprises reactors in which the aforementioned mixture undergoes endothermic reactions at temperatures approximately within the range of 350° to 900° C. at high pressure and in the presence of a catalyst. This installation further comprises a furnace placed upstream of each reactor for reheating the gas mixture prior to introduction of the mixture into the reactor.

The invention is primarily applicable to the following installations:

reforming of petroleum naphtha in the presence of a platinum-base catalyst in order to obtain gasolines;

hydrogen desulfurization of hydrocarbons.

In known installations, furnaces for reheating the gaseous mixture of hydrocarbons and hydrogen are conventional furnaces supplied with liquid or gaseous fossil fuel. These furnaces are equipped with bundles of small-section tubes which are heated by combustion of the fossil fuel and in which the aforementioned gas mixture is circulated.

These reheating furnaces are attended by a large numer of drawbacks.

In the first place, the circulation of the gas mixture to be reheated within the tube bundles causes substantial pressure drops, thus making it necessary to use compressors which have very high power ratings and consequently consume a considerable amount of energy.

Furthermore, temperature regulation in furnaces of this type is difficult to achieve and calls for very close attention on the part of operators of installations.

In the case of a catalytic reforming installation, care must be taken to ensure in particular that the surface temperature of the furnace tubes does not exceed 650° C. in order to avoid any danger of tube failure, which would have catastrophic consequences.

It has also been observed that, on account of the shape of the flame, substantial variations in surface temperature occur along the tubes within one and the same tube section and may be variable according to the position of the tube considered.

In addition, the flame-type furnaces mentioned above are of large size, mainly by reason of the fact that a single bank of tubes surrounds the flame.

Another drawback lies in the fact that the thermal efficiency of these furnaces scarcely exceeds 80%, even in the event that the heat removed in the fossil fuel combustion smoke is recovered by heat exchange.

Finally, the use of fossil fuel for the operation of these furnaces results in additional consumption of a costly power-generating product which it has now become necessary to economize, especially in western countries, in order to limit the use of this source of power to applications in which it is strictly indispensable.

The aim of the present invention is to provide an installation which overcomes all the disadvantages mentioned in the foregoing.

The installation contemplated by the invention for chemical conversion of a gas mixture containing in particular hydrogen and hydrocarbons comprises a series of reactors in which the aforementioned mixture undergoes generally endothermic reactions at temperatures approximately within the range of 400° C. to 900° C. under high pressure and in the presence of a catalyst. A furnace is placed upstream of each reactor in order to reheat the gas mixture prior to introduction into said reactor.

In accordance with the invention, this installation is distinguished by the fact that the furnaces are constituted by an enclosure having an inlet and an outlet for the gas mixture and containing one or a number of electric heating resistors which are intended to be placed in direct contact with the gas mixture as this latter is introduced into said enclosure.

These electric furnaces in which the electric resistor is in direct contact with the gas mixture exhibit a pressure drop which is distinctly lower than that of conventional furnaces.

Furnaces equipped with electric heating resistors thus replace the furnaces which are supplied with fossil fuel such as light or heavy fuel.

In consequence, it is possible either to reduce the power rating of the compressors employed for recycling the gaseous effluents or to reduce the overall power consumption of the installation by adding one or a number of additional charge/effluent heat-exchangers.

Moreover, these electric furnaces make it possible to regulate the heating temperature of the gas mixture with much greater ease and accuracy than in the case of conventional furnaces, thus guarding against any potential danger of overheating which might otherwise give rise to accident conditions and also of insufficient heating which would be liable to reduce the efficiency of reactions.

A further point worthy of note is that the thermal efficieny of these furnaces is distinctly higher than that of conventional furnaces.

Moreover, the fact that electricity is employed as a source of power in these furnaces dispenses with any need for additional consumption of fossil fuel, the cost of which is steadily rising in comparison with the cost of electricity produced in hydroelectric and nuclear power stations.

In a particular embodiment of the invention, the installation comprises in parallel with each furnace supplied with fossil fuel an electric furnace constituted by an enclosure provided with an inlet and an outlet for the gas mixture and with one or a number of electric heating resistors which are intended to be placed directly in contact with the gas mixture as this latter is introduced into said enclosure, and means for circulating the gas mixture at will either within the furnaces supplied with fossil fuel or within the electric resistance furnaces.

By way of example, an installation of this type could thus operate in a conventional manner during the winter months by employing conventional furnaces supplies with fossil fuel whereas electric furnaces could be employed at other times during periods of lower consumption in which electricity can be produced at lower cost.

Other features of the invention will be more apparent upon consideration of the following description and accompanying drawings, wherein:

FIG. 1 illustrates diagrammatically an installation for catalytic reforming of naphtha which is obtained by distillation of crude oil and which is intended to produce gasolines having a high octane number.

Figure 1:
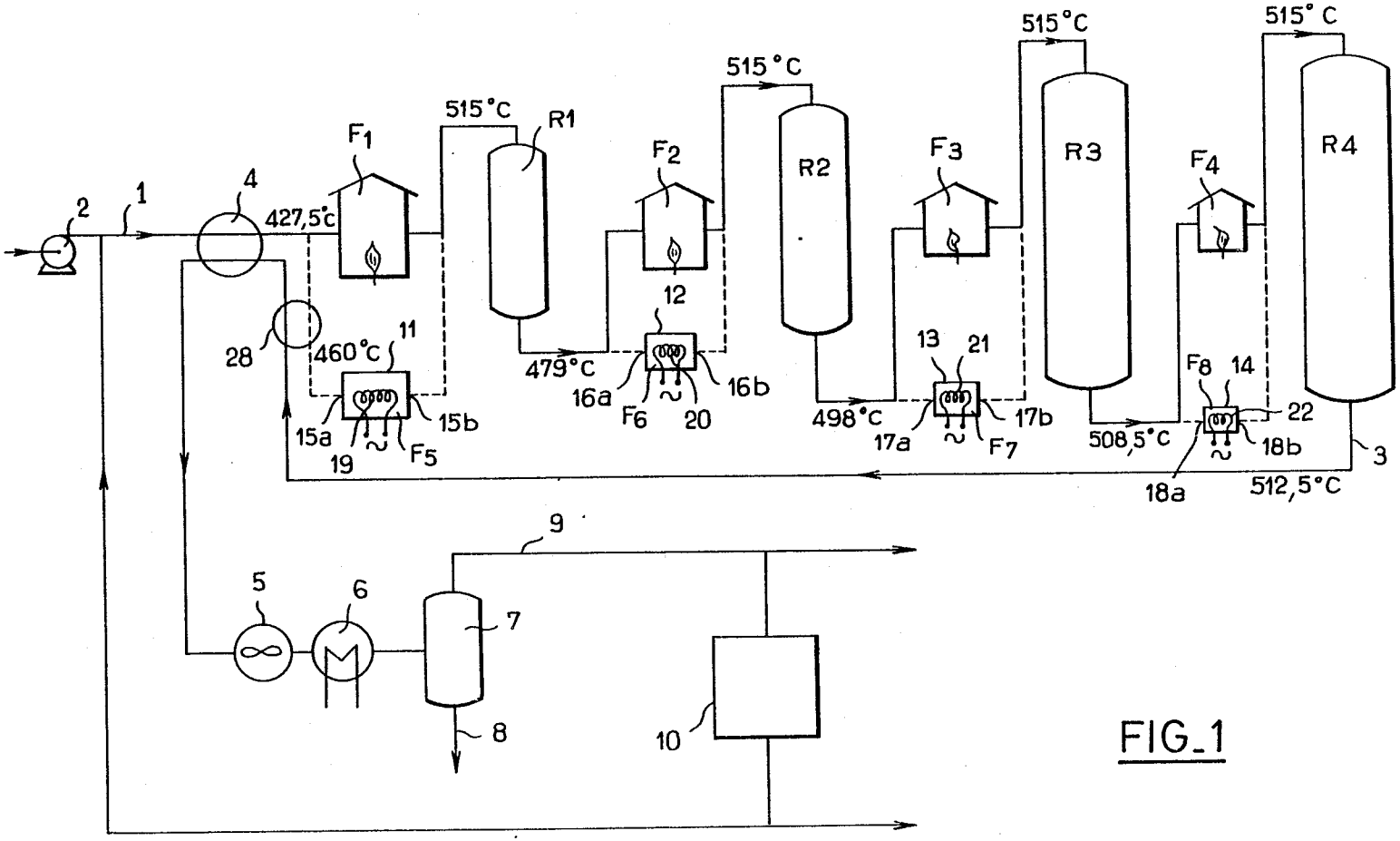
FIG. 1 is a general schematic diagram of an installation for catalytic reforming of naphtha.

This installation comprises four reactors $R_1$, $R_2$, $R_3$, $R_4$ in which reforming reactions are carried out between a gaseous mixture of hydrocarbons enriched in hydrogen at temperatures in the vicinity of 500° C., at pressures within the range of 15 to 30 bar, and in the presence of a platinum-base catalyst.

These reactions are generally endothermic.

To this end, a furnace $F_1$, $F_2$, $F_3$, $F_4$ is placed upstream of each reactor $R_1$, $R_2$, $R_3$, $R_4$ and serves to preheat the mixture of hydrocarbons and hydrogen to the optimum temperature prior to admission of said mixture into the following reactor $R_1$, $R_2$, $R_3$, $R_4$.

The hydrogen-enriched mixture 1 of hydrocarbons is introduced into the first furnace $F_1$ by means of a pump 2. The effluent 3 discharged from the last reactor $R_4$ passes into heat exchanger 4 placed upstream of the first furnace $F_1$ and designed to produce a heat transfer between said effluent 3 and the gas mixture 1 which is introduced into the first furnace $F_1$. This heat transfer process has the effect of preheating the initial gas mixture 1 before this latter enters the furnace $F_1$.

After said heat transfer, the effluent 3 is cooled within an air-cooler 5, then within a water-cooler 6 before passing into a separating drum 7 in which the gas to be recycled is separated from the reformate. This reformate is recovered at 8. Part of the gas 9 discharged from the separator 7 for recycling is compressed by means of a compressor 10 which reinjects it downstream of the pump 2 for mixing said gas with the feed naphtha.

In accordance with the invention, the installation comprises, in parallel with each furnace $F_1$, $F_2$, $F_3$, $F_4$ which is supplied with fossil fuel, a furnace $F_5$, $F_6$, $F_7$, $F_8$ constituted by an enclosure 11, 12, 13, 14 provided with an inlet 15*a*, 16*a*, 17*a*, 18*a* and an outlet 15*b*, 16*b*, 17*b*, 18*b*. Each enclosure contains electric heating resistors 19, 20, 21, 22.

These heating resistors 19 to 22 are placed in direct contact with the gas mixture which is fed into each electric furnace $F_5$, $F_6$, $F_7$, $F_8$.

These electric furnaces $F_5$, $F_6$, $F_7$, $F_8$ are so designed and constructed that the mixture of hydrogen and hydrocarbons flows through said furnaces with a low pressure drop.

The structure of the electric furnaces $F_5$–$F_8$ is shown in FIGS. 4–18.

In the embodiment of the electric furnace shown in FIGS. 4–7, there is shown a high-power device for electric heating of a gas mixture by direct Joule effect, the mixture being heated to temperatures and pressures which may attain 900° C. and 60 bar respectively.

Figure 4:
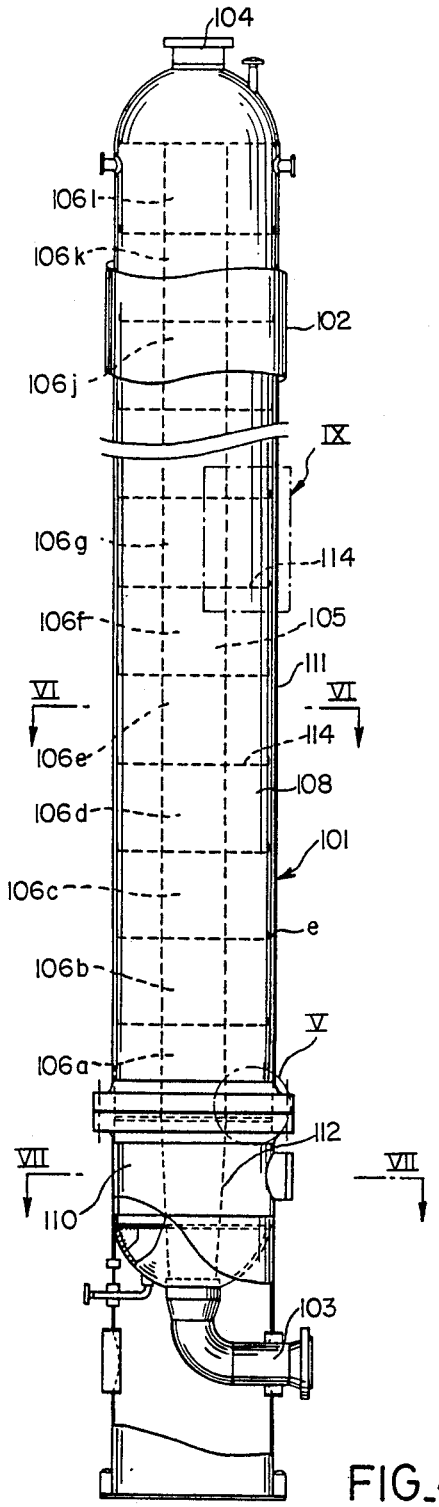
FIG. 4 is a fragmentary view in elevation showing an electric heating device in accordance with the invention.

This device comprises a vertical enclosure 101 of generally cylindrical shape and provided with an internal heat-insulating lining or external heat-insulating jacket 102 which is shown only partially in FIG. 4. The lower end of the enclosure 101 comprises a domed bottom section with an inlet nozzle 103 and the upper portion of the enclosure comprises a shell with a top outlet nozzle 104 for the delivery of the gas mixture to be heated.

Said enclosure 101 has a central duct 105 as shown in dashed outline in FIG. 4. Said duct connects the gas mixture inlet 103 to the outlet 104 and contains a plurality of identical modules 106*a*, 106*b*, 106*c*, 106*d*, . . . 106*k*, 106*l*) which are placed in superposed relation and are removable.

These modules 106*a*, . . . 106*l* each comprise a plurality of banks of resistance elements which are coupled in series and in parallel.

Figure 5:
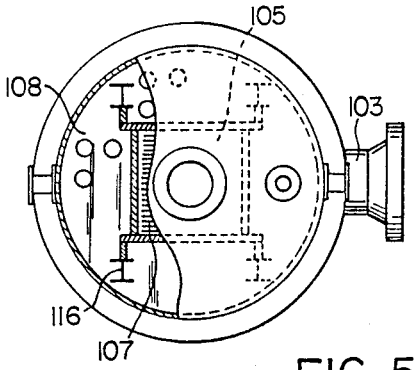
FIG. 5 is a fragmentary plan view to a larger scale showing the top portion of the device.
Figure 6:
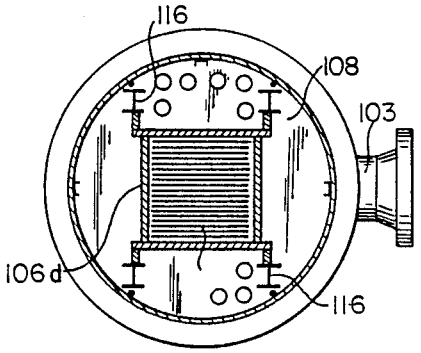
FIG. 6 is a sectional view to a larger scale and taken along the plane III—III of FIG. 4.
Figure 7:
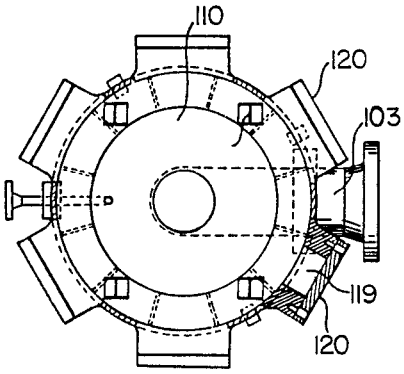
FIG. 7 is a sectional view to a larger scale, this view being taken along the plane of junction between the domed bottom section and the shell.
Figure 9:
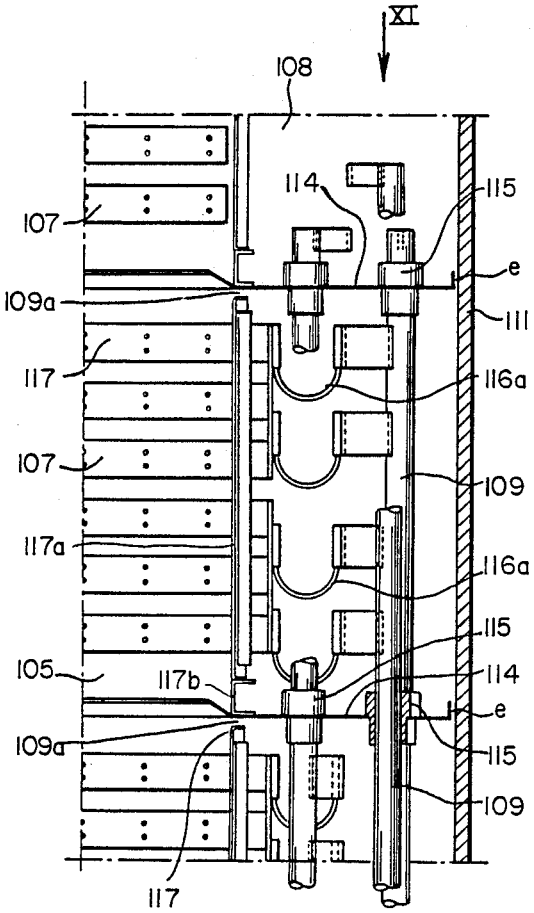
FIG. 9 is a longitudinal sectional view to a larger scale and shows the detail VI of FIG. 4.
Figure 10:
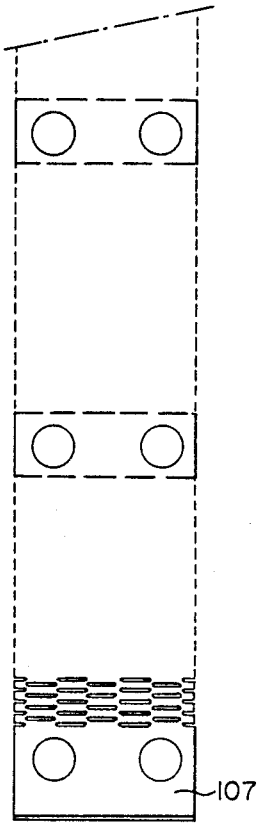
FIG. 10 is a partial view of a resistance strip of the device.

As shown in FIGS. 5 and 6, and more clearly in FIGS. 9, 10, 12 and 13, the aforementioned resistance elements consist of metallic strips 107 placed in adjacent relation. These resistance strips 107 are of bare expanded sheet metal (as shown in FIG. 10) and are arranged parallel to the vertical axis of the device. These strips have a thickness of a few tenth of a millimeter and are maintained in spaced relation by heat-resistance insulating rings (of alumina, for example). The spacing between the resistance strips 107 is so determined as to obtain optimum heat transfer between these strips and the gas to be heated and to provide a minimum bulk while nevertheless being sufficient to ensure that the pressure drops are negligible. In practice, the resistance strips 107 have a relative spacing of one to two centimeters for electrical insulation between strips at different potentials.

The central duct 105 constituted by the superposed modules 106*a*, . . . 106*l* is surrounded by a peripheral zone 108 (as shown in FIGS. 4, 5, 6, 9 and 11–13) containing the conductors 109 for supplying electric current to the modules 106*a*, . . . 106*l* which enclose the resistance strips 107.

Moreover as shown in FIG. 9, passages 109*a* are formed between the central duct 105 and the peripheral zone 108 in order to permit the flow of a small proportion of the gas stream into the peripheral zone 108 for the purpose of cooling the tubes and balancing the pressures between the central duct and the peripheral zone.

As indicated in FIGS. 4, 7, 14 and 15, the enclosure 101 has a domed bottom section 110 provided with the inlet nozzle 103 for admission of the gas mixture. A vertical shell 111 is removably mounted on said bottom section in fluid-tight manner and adapted to carry the top nozzle 104 through which the gas mixture to be heated is discharged.

The superposed modules 106*a*, . . . 106*l* contained within the shell 111 are placed one above the other along the vertical axis of the shell. Said modules communicate with the inlet nozzle 103 by means of a coupling sleeve 112 which is widened-out at the top (as shown in FIG. 4). Moreover, said modules 106*a*, . . . 106*l* are free with respect to the side wall and the top portion of the shell 111.

As shown in FIGS. 5, 6, 9, 12 and 13, the modules 106*a*, . . . 106*l* are constituted by parallelepipedal sheet-metal boxes which are closed at the sides removably fixed one above the other in the line of extension of their lateral faces.

Figure 8:
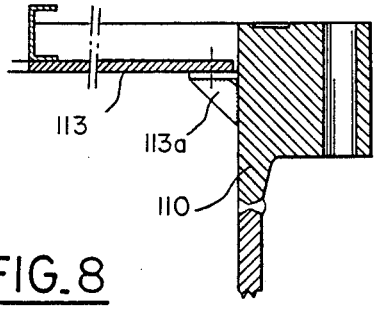
FIG. 8 is a longitudinal sectional view to a larger scale and shows the detail V of FIG. 4.

The complete assembly formed by all the modules 106*a*, . . . 106*l* rests on a bottom plate 113 (as shown in FIG. 8) which is in turn supported on an internal ledge 113*a* of the domed bottom section 110.

As shown in FIGS. 4, 9, 12 and 13, each module 106*a*, . . . 106*l* is supported by a peripheral plate which extends over practically the entire width of the peripheral zone. This plate is in turn fixed on the general internal support frame 116. The small clearance space e provided between the outer edge of these peripheral module plates 114 and the wall of the shell 111 is calculated so as to ensure that said plates 114 are capable of expanding under the action of the heat generated by the electric resistors contained within the modules 106*a*, . . . 106*l* but are not liable to come into contact with the wall of the shell 111.

Figure 11:
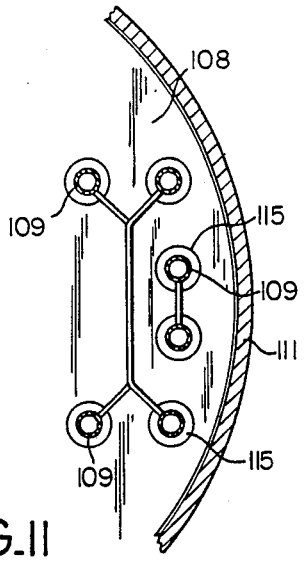
FIG. 11 is a view looking in the direction of the arrow VIII of FIG. 9.
Figure 12:
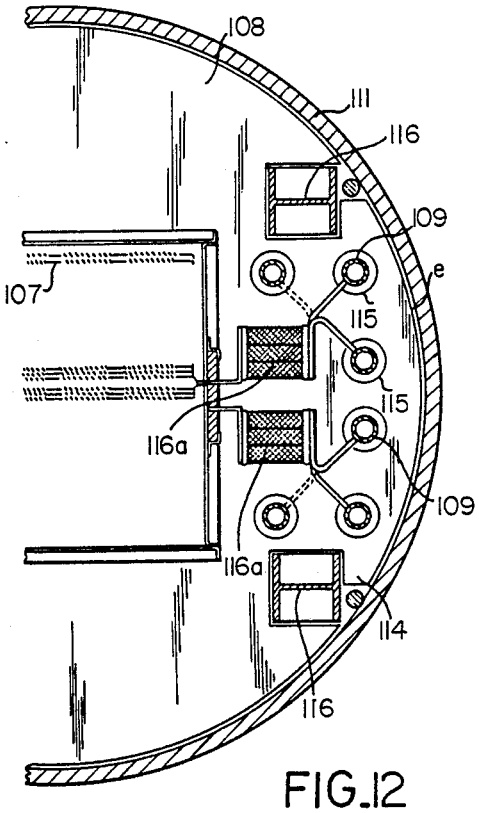
FIG. 12 is a large-scale transverse part-sectional view of the device and shows the connection between the supply conductors and the electric resistors.
Figure 13:
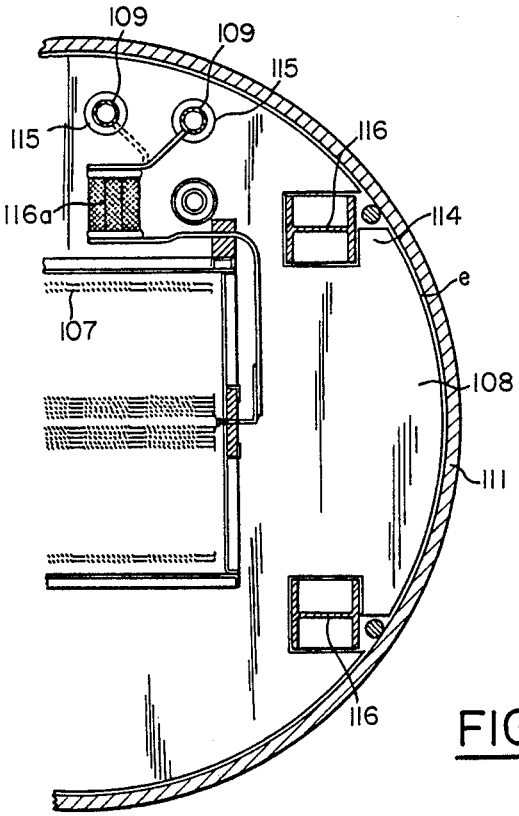
FIG. 13 is a view which is similar to FIG. 12 and shows another mode of connection between the conductors and the resistors, thus permitting a peripheral distribution of the conductors.

The module plates 114 are provided with openings in which are engaged sleeves 115 of insulating material which surround the electric conductors 109 for supplying current to the modules 106*a*, . . . *106l* (as shown in FIG. 9 and in FIGS. 11–13).

The complete assembly consisting of said modules 106*a*, . . . 106*l* is attached laterally to vertical structural members 116 (H-section members, for example) which extend within the peripheral zone 108 (as shown in FIGS. 5, 6, 12 and 13) and serve to support the internal equipment components.

The electric conductors 109 for supplying current to the modules 106*a*, . . . 106*l* are metal tubes which extend (as shown in FIG. 9 and in FIGS. 11–13) in a direction parallel to the axis of the shell 111 within the peripheral zone 108. These metal tubes 109 are connected by means of flexible braided-wire elements 116*a* to the electric resistance strips 107 contained within the modules 106*a*, . . . 106*l*.

In the embodiment illustrated (see FIG. 9), each module 106*a*, . . . 106*l* comprises two superposed sets of resistance strips 107. It is also shown in FIG. 9 that each module communicates with the adjacent peripheral zone 108 by means of a slit 109*a* having a width of a few millimeters and formed between the top edge 117 of the side wall of a module and the base plate 114 which supports the upper module. As can be seen in FIG. 9, each such side wall is comprised by a plate 117*a* and a member 117*b* of C-shaped cross section.

Figure 15:
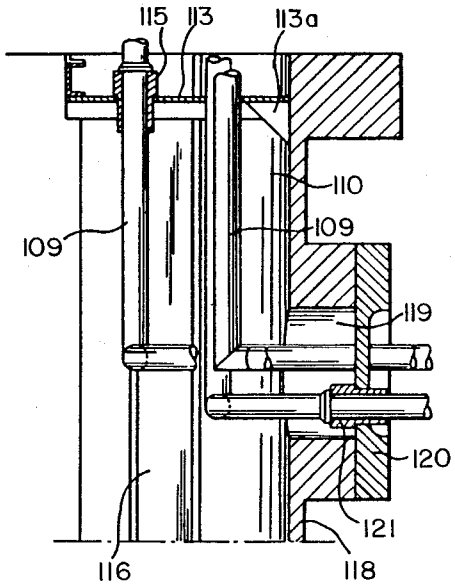
FIG. 15 is a large-scale longitudinal part-sectional view of the domed bottom section of the device and shows the lead-in connections for the electric conductors which supply the resistors.
Figure 14:
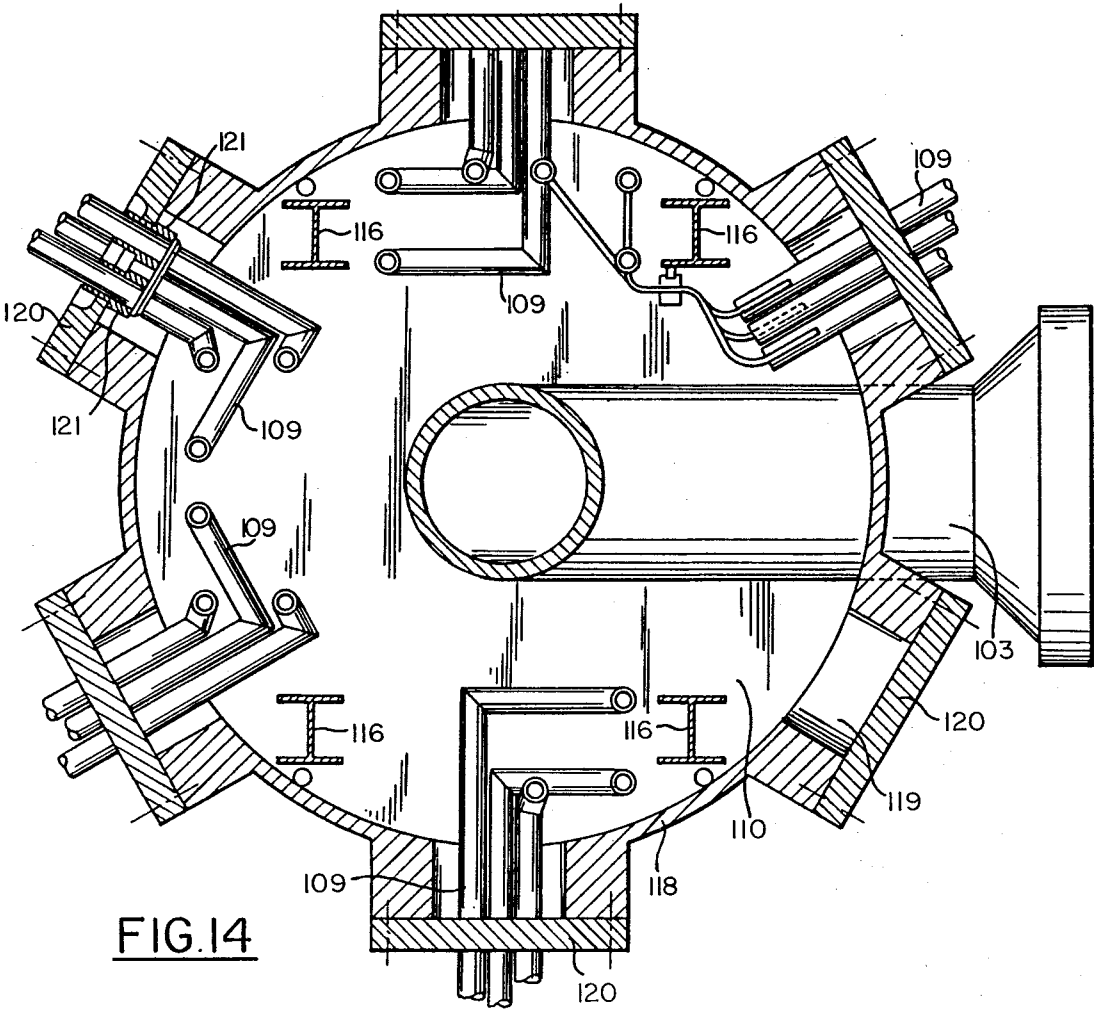
FIG. 14 is a sectional view to a larger scale along the plane IV—IV of FIG. 4 and shows the lead-in connections for the electric conductors which supply the resistors of the device in accordance with the invention.
Figure 17:
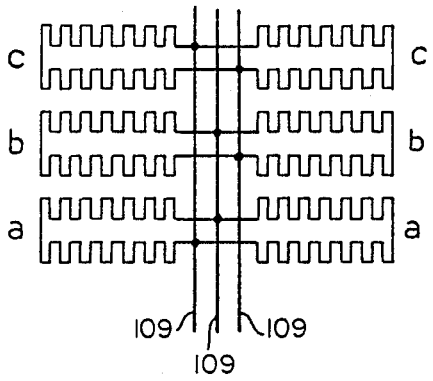
FIG. 17 is an electrical diagram showing a mode of connection between the conductors and the resistors of a standard module.

FIGS. 14 and 15 show that the domed bottom section 110 is provided in its side wall 118 with radial lead-in bushings 119 for the conductor tubes 109 which supply electric current to the modules 106*a*, . . . 106*l*.

Said lead-in bushings 119 are sealed by metal closure disks 120 traversed by insulating sleeves 121 which surround the metal conductor tubes 109. These tubes pass horizontally through the lead-in bushings 119, then extend vertically within the bottom compartment 110 and pass through the bottom support plate 113 of the module assembly.

In the example of FIG. 14, it is apparent that the domed bottom section 110 has five lead-in bushings 119 each traversed by three conductors 109 and a sixth passage which is left in reserve. The number of equipped penetrations is a function of the power and number of modules.

FIGS. 14–18 show the principle of electric power supply to the resistance modules of the electric furnace used in accordance with the invention.

Figure 16:
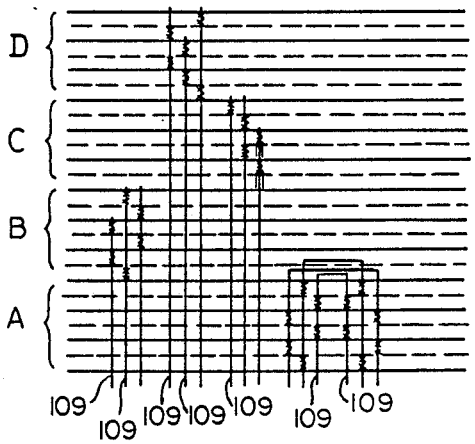
FIG. 16 is a diagram showing the electric connection between the different superposed modules.

The different modules illustrated diagrammatically in FIG. 16 are placed in superposed relation at four levels A, B, C, D, each level being composed of three modules. The upper levels B, C, D are each supplied by means of three conductors 109 in the manner shown diagrammatically in FIG. 17. In this figure, each single-phase element such as a, b, represents one module (for example the module 106*e*) which is supplied with single-phase power. A level such as B, C or D is formed of three single-phase modules and corresponds to a power rating within the range of 2–3 MW.

Each single-phase element such as a, b is composed of two banks which consist of twice twenty-seven resistance strips 107.

Figure 18:
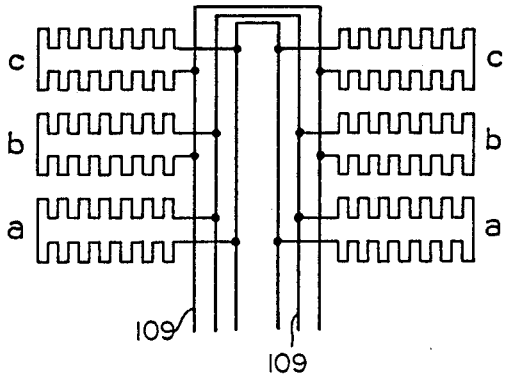
FIG. 18 is an electrical diagram showing a mode of connection between the conductors and the resistors of a high performance module.

The bottom level A is supplied by means of a pair of three conductors 109 as shown more clearly in FIG. 18. In this mode of power supply, the power attains 4–5 MW.

The electric heating device which has just been described offers many advantages over designs of the prior art.

In the first place, the device can readily be disassembled for such purposes as repair work, for example. To this end, it is only necessary to remove the shell 111 which surrounds the assembly of modules. This operation is particularly simple by reason of the fact that said shell is completely free with respect to the modules and their power supply conductors.

Moreover, the conductors 109 which supply electric power to the modules are subjected to efficient cooling by a small portion of the gas stream which flows within the peripheral zone 108, thus guaranteeing durability of the modules over an extended period of service.

Furthermore, the awkward problems arising from thermal expansion of the heating elements have been overcome in a simple and effective manner by virtue of the fact that the assembly of modules is capable of expanding freely toward the top portion of the shell 111.

It is also worthy of note that, in spite of the large amount of power dissipated per unit volume of the device, it has been possible to achieve a very small pressure drop by virtue of the small thickness of the resistance strips 107. This in turn permits a considerable reduction in power of the compressors and pumps employed for compressing and transporting the gas to be heated through the heating device.

Again another advantage is that the heating power delivered by each element can be adjusted independently of the other levels since the levels are each supplied separately.

Thus it is possible to obtain between the inlet and the outlet of the device an optimum temperature profile under the heating conditions which may be desired in the case of a specific application.

Furthermore, the electric furnace used in accordance with the invention is perfectly suited to heating of a gas under pressures which attain or exceed 60 bar, especially by virtue of the fact that the shell 111 is joined to the bottom section 110 of the device by means of a single seal and is not fitted with any coupling connector for the introduction of electric conductors or other element, thus considerably limiting any danger of gas leakage.

It will be readily understood that the invention is not limited to use of the electric furnace described in the foregoing example, and that any number of modifications may accordingly be contemplated without thereby departing from the scope of the invention.

From this it follows that the modules 106*a*, . . . 106*l* may not necessarily be parallelepipedal but could be cylindrical or could have any other tubular shape.

It should be added that the resistance strips 107 need not be of expanded metal and could be produced in a different manner. The only essential condition to be satisfied is that these strips must be provided with cut-out portions which permit enhanced resistance per unit area without affecting the free flow of gas to be heated between these strips.

It will be clearly apparent that, although this example makes provision for a three-phase alternating-current supply, this does not imply any limitation. The electric furnace used in accordance with the invention can be supplied with any type of electric current and in particular direct current.

Figure 2:
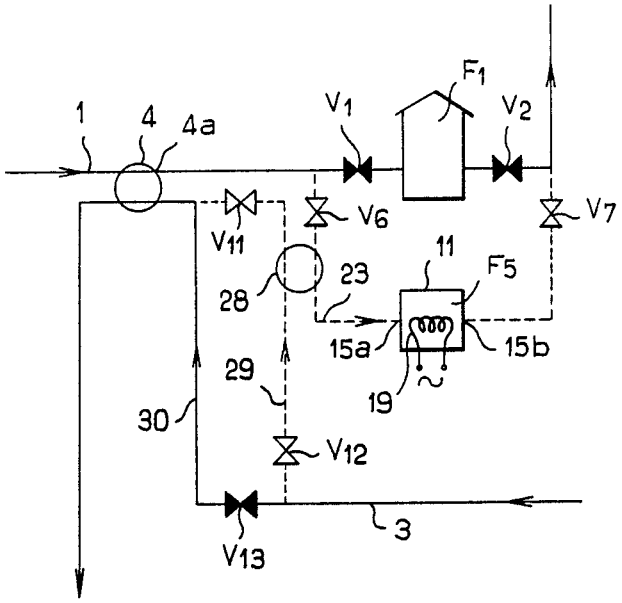
FIGS. 2 and 3 are partial views of the installation and show in particular the positions of the valves.
Figure 3:
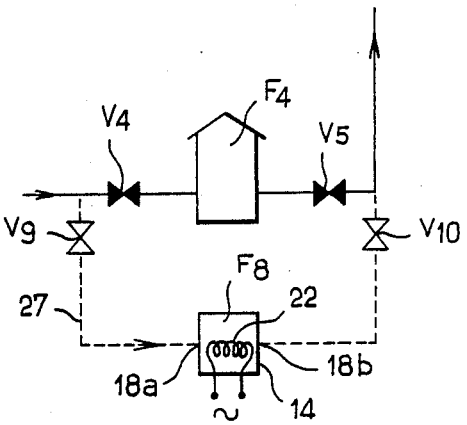

In addition, the installation in accordance with the invention comprises means for passing the gas mixture at will either through the conventional furnaces $F_1$, $F_2$, $F_3$, $F_4$ supplied with fossil fuel or through the electric resistance furnaces $F_5$, $F_6$, $F_7$, $F_8$. As shown in FIGS. 2 and 3, the means aforesaid are constituted by valves $V_1$, $V_2$, . . . $V_4$, $V_5$ which are placed at the inlet and at the outlet of the conventional furnaces $F_1$, . . . $F_4$ and by valves $V_6$, $V_7$, . . . $V_9$, $V_{10}$ placed on the bypass lines 23, . . . 27 which extend between the conventional furnaces $F_1$, . . . $F_4$ and the electric furnaces $F_5$, . . . $F_8$.

It is also apparent from FIGS. 1 and 2 that one or a number of additional heat exchangers 28 are placed on the bypass line 23 which extends between the outlet 4*a* of the first heat exchanger 4 and the inlet 15*a* of the first electric furnace $F_5$. These heat exchangers 28 are so arranged as to carry out a complementary heat transfer between the gas mixture which is introduced into the first electric furnace $F_5$ and the gaseous effluent 3 which is discharged from the last reactor $R_4$. Valves $V_{11}$, $V_{12}$ are placed on the upstream side and on the downstream side of the heat exchangers 28 in a circuit 29 which is connected to the circuit of the effluent 3. A valve $V_{13}$ is placed in a branch circuit 30 which is connected directly to the first heat exchanger 4. Said valves $V_{11}$, $V_{12}$ and $V_{13}$ make it possible to pass the effluent 3 into the heat exchangers 28 at the time of putting into service of the electric furnaces $F_5$, . . . $F_8$ or to pass said effluent directly and solely through the first heat exchanger 4 at the time of putting into service of the conventional furnaces $F_1$, . . . $F_4$.

The pressure drop produced by the heat exchanger or exchangers 28 is smaller than the reduction in pressure drop achieved at the time of putting into service of the electric furnaces $F_5$, . . . $F_8$.

The operating characteristics of an installation of the type shown in FIG. 1 for processing 1600 metric tons of naphtha per day are given in the following table.

| | | Operation with conventional furnaces | | Operation with electric furnaces |
|---|---|---|---|---|
| Thermal power | | | | |
| (Imparted to the process fluid) | $F_1$ | 14.5 MW | $F_5$ | 10 MW |
| | $F_2$ | 6 MW | $F_6$ | 6 MW |
| | $F_3$ | 3 MW | $F_7$ | 3 MW |
| | $F_4$ | 1 MW | $F_8$ | 1 MW |
| | Total: | 24.5 MW | Total: | 20 MW |
| Temperature in °C. | | | | |
| Inlet of furnace | $F_1$ | 427.5 | $F_5$ | 460 |
| Inlet of the four reactors | | 515° C. | | 515° C. |
| Outlet of the reactors | | | | |
| $R_1$ | | 479 | | 479 |
| $R_2$ | | 498 | | 498 |
| $R_3$ | | 508.5 | | 508.5 |
| $R_4$ | | 512.5 | | 512.5 |
| Pressures in bars | | | | |
| Inlet of compressor 10 | | 25.4 | | 25.4 |
| Outlet of compressor 10 | | 34.6 | | 33.2 |
| Pressure drops within the furnaces | $F_1$ | 1.4 | $F_5$ | 0.2 |
| | $F_2$ | 0.8 | $F_6$ | 0.15 |
| | $F_3$ | 0.7 | $F_7$ | 0.1 |
| | $F_4$ | 0.6 | $F_8$ | 0.05 |
| Within the heat exchangers (4), (28) | | | | |
| mixture side (1) | | 1.2 | | 1.65 |
| effluent side (3) | | 0.4 | | 0.55 |
| Within the air cooler (5) | | 0.4 | | 0.4 |
| Within the water cooler (6) | | 0.3 | | 0.3 |
| Within the supplementary valves | | — | | 1.0 |

It is apparent from a study of the above table that the pressure drops are much smaller in the electric furnaces $F_5$ to $F_8$ than in the conventional furnaces $F_1$ to $F_4$. The total gain thus achieved is of the order of 3 bar.

By virtue of this decrease in pressure drops, it would be possible to reduce the power of the compressor 10.

When the compressor 10 is retained, as is the case in the example shown in FIG. 1 and in the above table, the decrease in pressure drops provides the installation with a pressure-drop credit. This makes it possible to insert one or a number of supplementary heat exchangers 28 in the installation. By means of these supplementary exchangers, the initial mixture 1 can be brought to a temperature of at least 460° C. by heat exchange with the effluent 3 discharged from the last reactor $R_4$ prior to admission of said effluent into the first furnace $F_5$. This temperature of 460° C. can be compared with the temperature of 427.5° C. in the case of utilization of conventional furnaces.

In view of the fact that the gas mixture must be heated to about 525° C. prior to entry into the different reactors, it is possible by means of the supplementary heat exchangers 28 to reduce the power or in other words the energy consumption of the first electric furnace $F_5$.

It is found that, in the case of operation of the installation with electric furnaces $F_5$, $F_6$, $F_7$, $F_8$, a gain of 4.5 MW is achieved at the level of the first furnace $F_5$ with respect to the conventional furnaces.

Many other advantages are offered by the use of electric furnaces $F_5$ to $F_8$.

The fact that the installation is designed for dual-power operation which permits the use of either conventional furnaces or electric furnaces, the installation can be made immediately operational in the event of failure of the conventional furnaces without any need for total shutdown.

It is an advantage to operate the installation by means of the electric furnaces during periods of low total power consumption and when relatively inexpensive hydroelectric or nuclear power is available.

Furthermore, when the installation operates with the electric furnaces $F_5$ to $F_8$, the heating temperature of the gas mixture which is introduced into the different reactors can be adjusted with a very high degree of accuracy.

It is thus possible to avoid temperature variations about a reference value, to make more effective use of the catalyst at the point of admission of the reaction mixture, and to maintain its effectiveness over a longer period of time.

It will be readily apparent that the invention could be limited to the use of electric furnaces. In such a case, all conventional furnaces would be replaced and the installation would be specifically adapted to total operation with electric furnaces.

As a result of the gain in pressure drops achieved by the use of electric furnaces, it is possible either to reduce the power of the hydrogen-recycling compressor 10 to an appreciable extent or to increase the number of heat exchangers such as the exchangers 4, 28 which permit a reduction in total power of the electric furnaces, with the result that a substantial gain in power is achieved in all cases.

As can readily be understood, the invention could involve only partial replacement of conventional furnaces by one or a number of electric furnaces.

Alternatively, the number of furnaces and reactors could be increased by means of a correlative reduction in their respective sizes, thus tending toward a quasi-isothermal temperature profile within the catalyst. This would permit better utilization of the catalyst and therefore a reduction in total volume of catalyst and thus an economy in the supply of catalyst, the cost of which is particularly high since it has a base of noble and rare metals.

Moreover, in the case in which the pressure-drop credit provided by operation of the installation with electric furnaces is not employed for enhancing the charge-effluent heat transfer or in other words reducing the total power consumption, this pressure-drop credit permits operation of the installation with a higher degree of efficiency and especially more efficient use of the catalyst by adapting the operating conditions of the unit. For example, a reduction in mean pressure within the installation permits a higher gasoline yield.

It is clearly apparent that the invention is not limited to the example which has been described in the foregoing with reference to catalytic reforming of naphtha for the production of gasolines.

Thus the invention is applicable in all cases in which high-power heating of a mixture of hydrocarbons and hydrogen under high pressure is carried out upstream of one or a number of reactors in which totally endothermic reactions are carried out at temperatures approximately within the range of 350° C. to 900° C.

Thus the invention is also applicable in particular to installations for treatment of hydrocarbons by hydrogen desulfurization.

In all of these installations, replacement of conventional furnaces supplied with fossil fuel by electric furnaces having low pressure drops makes it possible to achieve a power economy of up to 45%, which is a wholly surprising result.

What is claimed is:

1. An installation for the chemical conversion of a gas mixture containing hydrogen and hydrocarbons, comprising a series of reactors having means for subjecting a gas mixture containing hydrogen and hydrocarbons to endothermic reactions at temperatures within the range of about 350° C. to 900° C. under high pressure and in the presence of a catalyst, and a plurality of furnaces with one of said plurality of furnaces being located before and in flow communication with each reactor in order to heat the gas mixture prior to introduction into its respective reactor, wherein each one of said plurality of furnaces is constituted by means defining an enclosure which has a lower inlet and an upper outlet for a gas mixture and contains bare electric resistors and conductors for the supply of electric current to said resistors, wherein each one of said plurality of furnaces further comprises a central duct having a lower end directly connected to said lower inlet and an upper end facing said upper outlet, said central duct having therein a plurality of superposed modules which are removable independently of each other, each module comprising a plurality of electric resistance elements, each said plurality of electric resistance elements being made up of banks of metallic strips, said strips being parallel to each other and to the direction along which a gas mixture flows between said inlet and said outlet of the means defining an enclosure, said strips having cut-out portions which permit enhanced resistance per unit area without affecting the free flow of gas to be heated between said strips, a peripheral zone within each one of said plurality of furnaces and surrounding said central duct, each said peripheral zone containing the conductors for the supply of electric current to the resistance elements, and a plurality of passages formed between the central duct and the peripheral zone in order that a small proportion of a gas flow which passes through the central duct may be permitted to flow within the peripheral zone.

2. An installation for the chemical conversion of a gas mixture containing hydrogen and hydrocarbons, comprising a series of reactors having means for subjecting a gas mixture containing hydrogen and hydrocarbons to endothermic reactions at temperatures within the range of about 350° C. to 900° C. under high pressure and in the presence of a catalyst, and a plurality of furnaces supplied with a fossil fuel with one of said plurality of furnaces being located before and in flow communication with each reactor in order to heat the gas mixture prior to introduction into its respective reactor, wherein said installation further comprises a plurality of electric furnaces, each one of said plurality of electric furnaces being connected in parallel with a respective one of said plurality of furnaces supplied with fossil fuel, each one of said plurality of electric furnaces comprising means defining an enclosure which has a lower inlet and an upper outlet for a gas mixture and contains bare electric resistors and conductors for the supply of electric current to said resistors, wherein each said electric furnace further comprises a central duct having a lower end directly connected to said lower inlet and an upper end facing said upper outlet, said central duct having therein a plurality of superposed modules which are removable independently of each other, each module comprising a plurality of electric resistance elements, each said plurality of electric resistance elements being made up of banks of metallic strips, said strips being parallel to each other and to the direction along which a gas mixture flows between said inlet and said outlet of the means defining an enclosure, said strips having cut-out portions which permit enhanced resistance per unit area without affecting the free flow of gas to be heated between said strips, a peripheral zone within each said electric furnace and surrounding said central duct, each said peripheral zone containing the conductors for the supply of electric current to the resistance elements, a plurality of passages formed between the central duct and the peripheral zone in order that a small proportion of a gas flow which passes through the central duct may be permitted to flow within the peripheral zone, and means for selectively flowing a gas mixture either through the furnaces supplied with fossil fuel or through the electric resistance furnaces, and then to each said reactor.

3. An installation according to claim 2 for the catalytic reforming of naphtha, comprising heat exchange means comprising a first heat exchanger located upstream of that pair of fossil fuel and electric furnaces which is located upstream of the first of said series of reactors for heat transfer between a gas mixture to be introduced into said series of reactors aand a gaseous effluent discharged from said series of reactors, said heat exchange means further comprising a bypass conduit in which said electric furnace of said pair is located, and at least one second heat exchanger disposed in said bypass conduit between an outlet of said first heat exchanger and said lower inlet of said electric furnace of said pair, said at least one second heat exchanger being constructed and arranged to effect a complementary heat transfer between a gas mixture introduced into said bypass conduit and a gaseous effluent discharged from said series of reactors.

4. An installation according to claim 3, further comprising means for passing a gaseous effluent from said series of reactors selectively either into said at least one second heat exchanger and thereafter into said first heat exchanger when at least part of the electric furnaces are put into service, or directly and solely into said first heat exchanger when the furnaces supplied with fossil fuel are all in service.

* * * * *